US006477711B1

(12) United States Patent
Freeman et al.

(10) Patent No.: US 6,477,711 B1
(45) Date of Patent: Nov. 12, 2002

(54) UNITARY GARMENT

(76) Inventors: Anita Freeman, 7121 Rocky Fork Rd., Wise, VA (US) 24293; Billie Freeman, 7121 Rocky Fork Rd., Wise, VA (US) 24293

( * ) Notice: Subject to any disclaimer, the term of this patent is extended or adjusted under 35 U.S.C. 154(b) by 0 days.

(21) Appl. No.: 09/991,029

(22) Filed: Nov. 21, 2001

(51) Int. Cl.[7] ..... A41B 9/00
(52) U.S. Cl. ..... 2/69; 2/78.2
(58) Field of Search ..... 2/69, 456, 79, 2/78.2, 227, 114, 408, 228, 238, 69.5, 83, 85, 93, DIG. 1, 338

(56) References Cited

U.S. PATENT DOCUMENTS

| | | | | | |
|---|---|---|---|---|---|
| 1,192,288 | A | * | 7/1916 | Emery | 2/79 |
| 1,783,538 | A | * | 12/1930 | Herskowitz | 2/79 |
| 1,799,336 | A | * | 4/1931 | Walser | 2/71 |
| 1,976,126 | A | | 10/1934 | Hickerson | |
| 2,519,202 | A | | 8/1950 | Slater | |
| 2,849,717 | A | * | 9/1958 | Klotz | 2/79 |
| 4,447,911 | A | | 5/1984 | Marcellaro | |
| D279,042 | S | | 6/1985 | Aquilina et al. | |
| 4,613,991 | A | | 9/1986 | Grover | |
| 4,667,344 | A | * | 5/1987 | Cooper, III | 2/227 |
| 5,010,595 | A | | 4/1991 | Stradley | |
| 5,179,942 | A | * | 1/1993 | Drulias et al. | 128/101.1 |
| 5,509,147 | A | * | 4/1996 | Busquets | 112/441 |
| 5,896,581 | A | * | 4/1999 | Wong | 2/227 |
| 6,289,524 | B1 | * | 9/2001 | Wright et al. | 2/455 |

* cited by examiner

*Primary Examiner*—John J. Calvert
*Assistant Examiner*—Tejash Patel

(57) ABSTRACT

A unitary garment for covering a head, torso, and legs of a user and for allowing a user to use the bathroom without removing the unitary garment. The unitary garment includes a pair of coveralls that include a pants portion for receiving the legs of a user and a jacket portion for covering a torso of a user. The pants portion includes a pair of leg members that include of a pair of front leg panels and a pair of rear leg panels coupled together. The pants portion includes a buttocks area for covering a buttock of a user. The buttocks area of the pants portion includes a flap defining an opening for exposing the buttocks of a user. A closing means mounted on the flap and the rear leg panels is provided for selectively closing the opening in the buttocks area of the pants portion.

18 Claims, 2 Drawing Sheets

FIG. 3
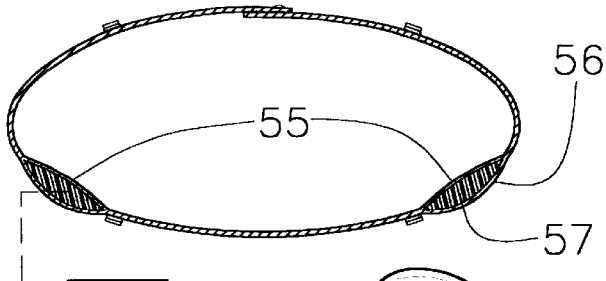
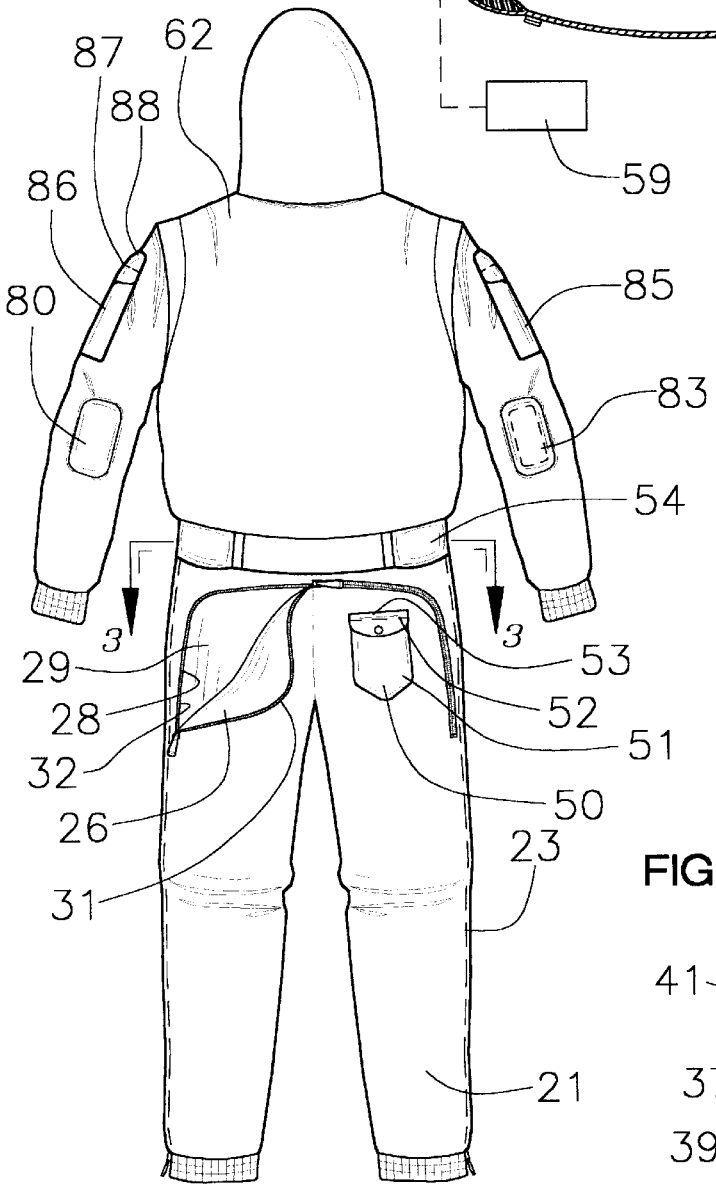
FIG. 2
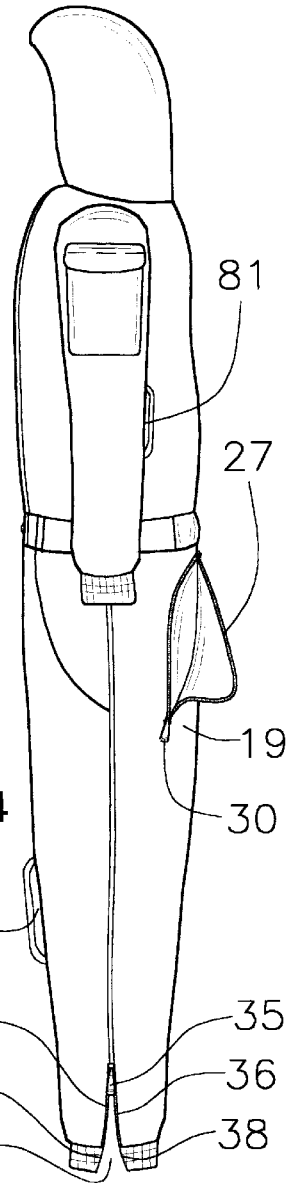
FIG. 4

UNITARY GARMENT

BACKGROUND OF THE INVENTION

1. Field of the Invention

The present invention relates to garments and more particularly pertains to a new unitary garment for covering a head, torso, and legs of a user and for allowing a user to use the bathroom without removing the unitary garment.

2. Description of the Prior Art

The use of garments is known in the prior art. More specifically, garments heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 1,976,126; 5,010,595; 4,447,911; 2,519,202; 4,613,991; and Des. 279,402.

While these devices fulfill their respective, particular objectives and requirements, the aforementioned patents do not disclose a new unitary garment. The inventive device includes a pair of coveralls that includes a pants portion for receiving the legs of a user and a jacket portion for covering a torso of a user. The pants portion includes a pair of leg members that include of a pair of front leg panels and a pair of rear leg panels coupled together. The pants portion includes a buttocks area for covering a buttock of a user. The buttocks area of the pants portion includes a flap defining an opening for exposing the buttocks of a user. A closing means is provided for selectively closing the opening in the buttocks area of the pants portion. The closing means includes a first portion and a second portion. The first portion is coupled to an edge of the flap and the second portion is coupled to an edge of a pair of rear leg panels of the pants portion. The first and second portions of the closing means are releaseably couplable.

In these respects, the unitary garments according to the present invention substantially departs from the conventional concepts and designs of the prior art, and in so doing provides an apparatus primarily developed for the purpose of covering a head, torso, and legs of a user and for allowing a user to use the bathroom without removing the unitary garment.

SUMMARY OF THE INVENTION

In view of the foregoing disadvantages inherent in the known types of garments now present in the prior art, the present invention provides a new unitary garments construction wherein the same can be utilized for covering a head, torso, and legs of a user and for allowing a user to use the bathroom without removing the unitary garment.

The general purpose of the present invention, which will be described subsequently in greater detail, is to provide a new unitary garments apparatus and method which has many of the advantages of the garments mentioned heretofore and many novel features that result in a new unitary garments which is not anticipated, rendered obvious, suggested, or even implied by any of the prior art garments, either alone or in any combination thereof.

To attain this, the present invention generally comprises a pair of coveralls that includes a pants portion for receiving the legs of a user and a jacket portion for covering a torso of a user. The pants portion includes a pair of leg members that include of a pair of front leg panels and a pair of rear leg panels coupled together. The pants portion includes a buttocks area for covering a buttock of a user. The buttocks area of the pants portion includes a flap defining an opening for exposing the buttocks of a user. A closing means is provided for selectively closing the opening in the buttocks area of the pants portion. The closing means includes a first portion and a second portion. The first portion is coupled to an edge of the flap and the second portion is coupled to an edge of a pair of rear leg panels of the pants portion. The first and second portions of the closing means are releaseably couplable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new unitary garments apparatus and method which has many of the advantages of the garments mentioned heretofore and many novel features that result in a new unitary garments which is not anticipated, rendered obvious, suggested, or even implied by any of the prior art garments, either alone or in any combination thereof.

It is another object of the present invention to provide a new unitary garment which may be easily and efficiently manufactured and marketed.

It is a further object of the present invention to provide a new unitary garment which is of a durable and reliable construction.

An even further object of the present invention is to provide a new unitary garment which is susceptible of a low cost of manufacture with regard to both materials and labor, and which accordingly is then susceptible of low prices of sale to the consuming public, thereby making such unitary garments economically available to the buying public.

Still yet another object of the present invention is to provide a new unitary garment which provides in the apparatuses and methods of the prior art some of the advantages thereof, while simultaneously overcoming some of the disadvantages normally associated therewith.

Still another object of the present invention is to provide a new unitary garment for covering a head, torso, and legs of a user and for allowing a user to use the bathroom without removing the unitary garment.

Yet another object of the present invention is to provide a new unitary garment which includes a pair of coveralls that includes a pants portion for receiving the legs of a user and a jacket portion for covering a torso of a user. The pants portion includes a pair of leg members that include of a pair of front leg panels and a pair of rear leg panels coupled together. The pants portion includes a buttocks area for covering a buttocks of a user. The buttocks area of the pants portion includes a flap defining an opening for exposing the buttocks of a user. A closing means is provided for selectively closing the opening in the buttocks area of the pants portion. The closing means includes a first portion and a second portion. The first portion is coupled to an edge of the flap and the second portion is coupled to an edge of a pair of rear leg panels of the pants portion. The first and second portions of the closing means are releaseably couplable.

Still yet another object of the present invention is to provide a new unitary garment that enables a wearer of the unitary garment to use bathroom facilities without having to remove the unitary garment.

Even still another object of the present invention is to provide a new unitary garment that permits hunters and military wearers of the unitary garment to use the bathroom out in the field without having to remove the unitary garment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a schematic rear view of the present invention.

FIG. 3 is a schematic cross-sectional view of the present invention taken along line 3—3 of FIG. 2.

FIG. 4 is a schematic side view of the present invention.

DESCRIPTION OF THE PREFERRED EMBODIMENT

Figure 1:
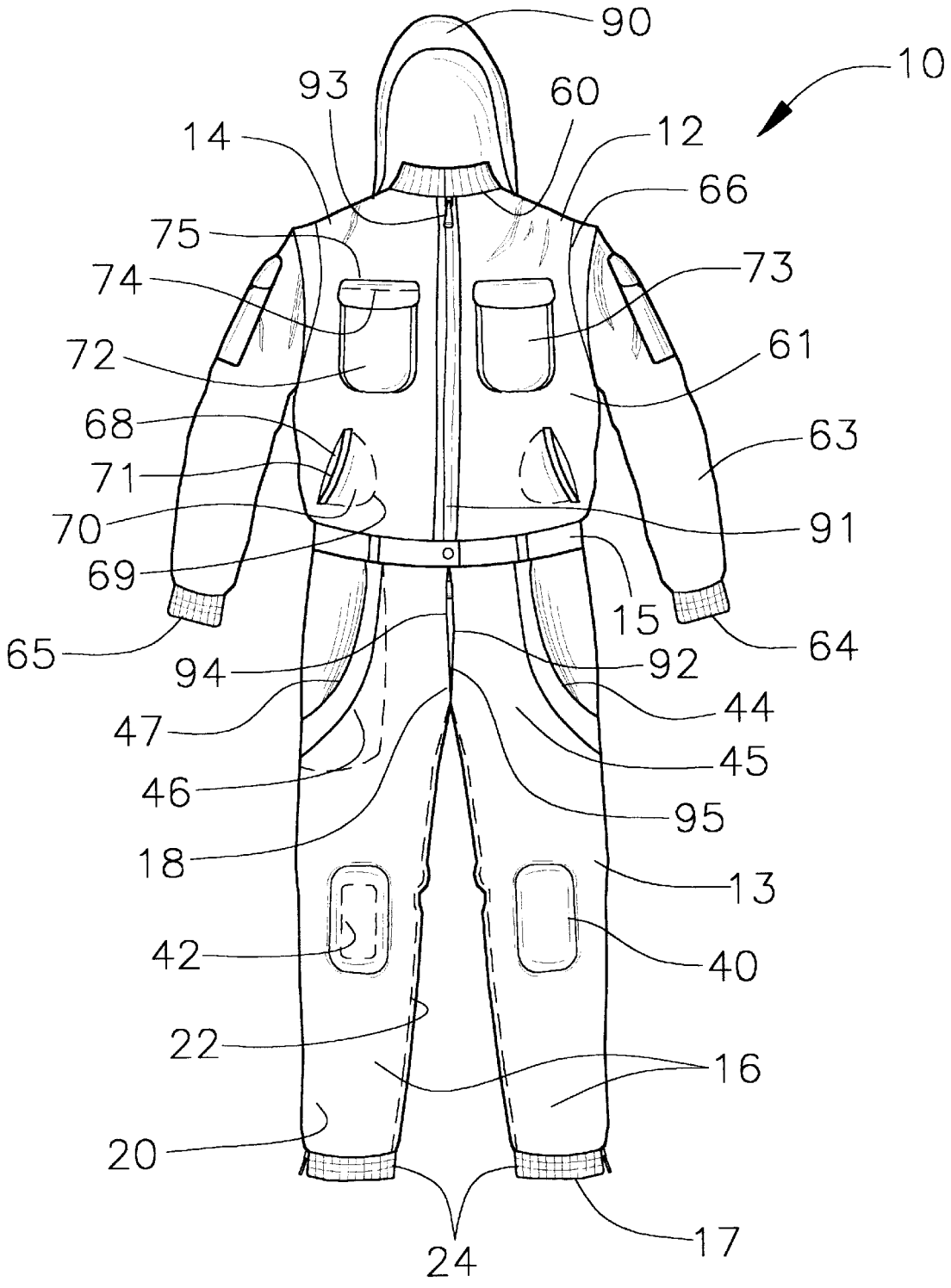
FIG. 1 is a schematic frontal view of a new unitary garment according to the present invention.

With reference now to the drawings, and in particular to FIGS. 1 through 4 thereof, a new unitary garments embodying the principles and concepts of the present invention and generally designated by the reference numeral 10 will be described.

As best illustrated in FIGS. 1 through 4, the unitary garments 10 generally comprises a pair of coveralls 12 that includes a pants portion 13 for receiving a pair of legs of a user and a jacket portion 14 for covering a torso of a user.

The pants portion 13 includes a waistband 15 and a pair of leg members 16 that are coupled to and extending away from the waistband 15. Each of the leg members 16 preferably includes an open end 17 for selectively receiving a foot of a user.

The pants portion 13 includes a crotch area 18 for selectively covering a crotch area of a user and a buttocks area 19 for selectively covering a buttocks area of a user. The crotch 18 and buttocks 19 area are positioned generally at a juncture of each of the leg members 16. The crotch 18 and buttocks 19 areas are positioned generally adjacent to the waistband 15 of the pants portion 13.

Each of the leg members 16 are comprised of a front leg panel 20 and a rear leg panel 21 coupled together such that an inseam 22 and an outseam 23 are defined at a juncture of the front 20 and rear 21 leg panels. The inseam 23 preferably extends between the crotch area 18 and the open end 17 of each of the leg members 16. The outseam 23 preferably extends between the waistband 15 and the open end 17 of each of the leg members 16.

A pair of leg cuffs 24 may be mounted on the open end 17 of each of the leg members 16 and may extend around the open end 17 of each of the leg members 16. Each of the leg cuffs 24 may comprise a substantially flexible material such as, for example, a cloth or leather material.

The buttocks area 19 of the pants portion 13 includes a flap 26. An edge 27 of the flap 26 and an edge 28 of each of the rear leg panels 21 defines an opening 29 for exposing the buttocks of a user and allowing the user to use the bathroom without having to remove the coveralls 12. The flap 26 may extend from a portion of each of the rear leg panels 21 of the leg members 16 toward the waistband 15. The flap 26 may have a hemicircular shape for providing maximum exposure of the buttocks of the user.

A closing means 30 is provided for selectively closing the opening 29 in the buttocks area 19 of the pants portion 13. The closing means 30 may include a first portion 31 and a second portion 32. The first portion 31 may be coupled to the edge 27 of the flap 26. The second portion 32 may be coupled to the edge 28 of the rear leg panels 21 of the pants portion 13. The first 31 and second 32 portions of the closing means 30 are releaseably couplable. The closing means 30 may comprise a zipper and may comprise a dual zipper.

The outseam 23 of each of the leg members 16 may include a slit 34 extending from each of the leg cuffs 24 toward the waistband 15 for selectively widening the open end 17 of each of the leg members 16. The slit 34 permits a user to more easily extend the leg members 16 over footwear worn by a user.

A closing means 35 may be provided for closing the slit 34 in each of the outseams 23. The closing means 35 for closing the slit 34 in each of the outseams 23 may include a first portion 36 and a second portion 37. The first portion 36 may be mounted on an edge 38 of the rear leg panel 21 of the leg members 16 and the second portion 37 may be mounted on an edge 39 of the front leg panel 20 of each of the leg members 16. The first 36 and second 37 portions of the closing means 35 for closing the slit 34 in each of the outseams 23 may be releaseably couplable. The closing means 35 for closing the slit 34 in each of the outseams 23 may comprise a zipper.

As illustrated in FIG. 1, a pair of kneepad panels 40 may be mounted on the front leg panels 20 of each of the leg members 16 for defining a cushioning compartment 41 between the front leg panels 20 and the kneepad panels 40. Each of the kneepad panels 40 may be positioned generally between the waistband 15 and the open end 17 of the leg members 16. Each of the kneepad panels 40 are preferably positioned on a portion of each of said leg members 16 covering a knee of a user. The pair of kneepad panels 40 may comprising a generally substantially flexible material such as, for example, a cloth or leather material.

A cushioning member 42 may be provided for cushioning a pair of knees of a user kneeling in the pants portion 13. The cushioning member 42 may be mounted in the cushioning compartment 41 defined by the kneepad panels 40 mounted on the front leg panels 20 of the leg members 16. The cushioning member 42 may comprise a compressible material such as, for example, a foam rubber, or cotton material.

The front leg panels 20 of each of the leg members 16 may include an opening 44 extending therein for providing access to a pair of front pockets 45. An inner pocket panel 46 may be coupled to an edge 47 of the front leg panels 20 defining the opening 44. The inner pocket panel 46 defines the interior of each of the front pockets 45. The opening 44 of each of the front pockets 45 may be positioned generally adjacent to the waistband 15.

A pair of rear pocket panels 50 may be mounted on the flap 26 of the buttocks area 19 of the pants portion 13 for defining a pair of rear pockets 51. An edge 52 of each of the rear pocket panels 50 defines an access opening 53 for accessing each of the rear pockets 51. Each of the rear pocket panels 50 may be positioned generally adjacent to the waistband 15 of the pants portion 13. The rear pockets 51 may include a flap for selectively closing the access opening 53. Each of the flaps may be mounted on the rear leg panels 21 and positioned generally adjacent to the access opening 53 of each of the rear pockets 51. An end of each of the flaps may be releaseably securable to the rear pocket panel 50 of each of the rear pockets 51. The pair of rear pocket panels 50 may comprise a generally flexible material such as, for example, a cloth or leather material.

A pair of waistband pocket panels 54 may be mounted on the waistband 15 of the pants portion 13 for defining a pair of waistband pockets 55. An edge 56 of each of the waistband pocket panels 54 defining an access opening 57 for accessing each of the waistband pockets 55. Each of the waistband pocket panels 54 maybe positioned generally adjacent to the buttocks area 19 of the pants portion 13.

As illustrated in FIG. 3, a heating means 59 may be provided for emitting heat and keeping the torso of a user warm. The heating means 59 maybe removably insertable in the waistband pockets 55. The heating means 59 may comprise a thermal pack.

The jacket portion 14 of the coveralls 12 includes an open collar end 60. A pair of breast jacket panels 61 is coupled to and extending between the open collar end 60 of the jacket portion 14 and the waistband 15 of the pants portion 13. A back jacket panel 62 is coupled to and extending between the open collar end 60 of the jacket portion 14 and the waistband 15 of the pants portion 13.

A pair of arm members 63 may be provided for receiving a pair of arms of a user. Each of the arm members 63 may be coupled to and extending away from the breast 61 and back 62 jacket panels of the jacket portion 14. Each of the arm members 63 includes an open end 64 for selectively receiving a hand of a user.

Each of the arm members 63 may include an arm cuff 65 mounted on the open end 64 of each of the arm members 63. Each of the arm cuffs 65 may comprise a substantially flexible material such as, for example, a cloth or leather material.

Each of the breast jacket panels 61 may include a plurality of pleats 66 formed therein for providing more room in the jacket portion 14 for a female user. Each of the pleats 66 may be positioned generally adjacent to one of the arm members 63.

As illustrated in FIG. 1, each of the breast jacket panels 61 may include an opening 68 extending therein for providing access to a pair of front jacket pockets 69. An edge 71 of the breast jacket panels 61 defines the opening 68. An inner pocket panel 70 may be coupled to the edge 71 of the breast jacket panels 61. The inner pocket panel 70 defines the interior of each of the front jacket pockets 69. The opening 68 of each of the front jacket pockets 69 may be positioned generally adjacent to the waistband 15 of the pants portion 13.

A pair of breast pocket panels 72 may be mounted on each of the breast jacket panels 61 for defining a pair of breast pockets 73. An edge 74 of each of the breast pocket panels 72 defining an access opening 75 for accessing each of the breast pockets 73. Each of the breast pocket panels 72 may be positioned generally adjacent to the open collar end 60 of the jacket portion 14.

As illustrated in FIG. 2, a pair of elbow pad panels 80 may be mounted on the each of the arm members 63 for defining a cushioning compartment 81 between the arm members 61 and the elbow pad panels 80. Each of the elbow pad panels 80 may be positioned generally between open end 64 of each of the arm members 63 and the breast 61 and back 62 jacket panels. The pair of elbow pad panels 80 may comprise a generally substantially flexible material such as, for example, a cloth or leather material.

A cushioning member 83 may be provided for cushioning a pair of elbows of a user. The cushioning member 83 may be mounted in the cushioning compartment 81 between the arm members 63 and the elbow pad panels 80. The cushioning member 80 may comprise a generally compressible material such as, for example, a foam rubber or cotton material.

A pair of arm pocket panels 85 may be mounted on each of the arm members 63 for defining a pair of arm pockets 86. An edge 87 of each of the arm pocket panels 85 defining an access opening 88 for accessing each of the arm pockets 86. Each of the arm pocket panels 85 may be positioned generally adjacent to the breast 61 and back 62 jacket panels. Each of the arm pockets 86 may include a flap for selectively closing the access opening 88 for accessing each of the arm pockets 86. The flap may be mounted on the arm member 63 and may be positioned generally adjacent to the access opening 88 for the arm pockets 86. An end of the flap may be securable to the arm pocket panels 85.

Each of the arm pocket panels 85 preferably comprises a substantially waterproof material to protect contents stored in the arm pockets 86 from water damage. Each of the arm pocket panels 85 may comprise a plastic material or a cloth material treated with a waterproofing agent. A variety of waterproofing techniques known in the prior art may be employed to make the arm pockets panels 85 waterproof.

A hood member 90 may be mounted on the back jacket panel 62 of the jacket portion 14 for selectively covering a head of user. The hood member 90 may be positioned generally adjacent to the open collar end 60 of the jacket portion 14.

The coveralls 12 may include a slit 91 extending between the open collar end 60 of the jacket portion 17 and the crotch area 18 of the pants portion 13 for allowing a user to put on the coveralls 12. An edge 92 of the breast jacket panels 61 and the front leg panels 20 define the slit 91 in the coveralls 12.

A closing means 93 may be provided for closing the slit 91 in the coveralls 12. The closing means 93 for closing the slit 91 in the coveralls 12 may include a first portion 94 and a second portion 95. The first 94 and second 95 portions of the closing means 93 for closing the slit 91 in the coveralls 12 may be mounted on the edge 92 of the breast jacket panels 61 and the front leg panels 20. The closing means 93 for closing the slit 91 in the coveralls 12 may comprise a zipper and may additionally comprise a dual zipper.

In use, the coveralls 12 may be worn by a user working, playing or hunting outdoors. The coveralls 12 permit a user to use the bathroom without having to remove the coveralls 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A unitary garment for covering a head, torso, and legs of a user, said unitary garment comprising:

a pair of coveralls having a pants portion for receiving the legs of a user and a jacket portion for covering a torso of a user;

said pants portion including a pair of leg members having a pair of front leg panels and a pair of rear leg panels coupled together;

said pants portion including a buttocks area for covering a buttocks of a user;

said buttocks area of said pants portion including a flap defining an opening for exposing the buttocks of a user;

a pair of rear pocket panels being mounted on said flap of said buttocks area of said pants portion for defining a pair of rear pockets positioned adjacent to the buttocks of a user when said flap of said buttocks area of said pants portion is closed; and a closing means for closing said opening in said buttocks area of said pants portion, said closing means including a first portion and a second portion, said first portion being coupled to an edge of said flap, said second portion being coupled to an edge of a pair of rear leg panels of said pants portion defining said opening, said first portion and said second portion of said closing means being releasably couplable.

2. The unitary garment of claim 1, wherein said pants portion includes a waistband, said pair of leg members being coupled to and extending away from said waistband, each of said leg members having an open end for selectively receiving a foot of a user.

3. The unitary garment of claim 2, wherein said flap extends from a portion of each of said rear leg panels of said leg members toward said waistband.

4. The unitary garment of claim 2, additionally including a pair of waistband pocket panels being mounted on said waistband of said pants portion for defining a pair of waistband pockets, an edge of each of said waistband pocket panels defining an access opening for accessing each of said waistband pockets.

5. The unitary garment of claim 4, additionally including a heating means for emitting heat and keeping the torso of a user warm, said heating means being removably insertable in said waistband pockets.

6. The unitary garment of claim 1, wherein each of said front leg panels and said rear leg panels is coupled together such that an inseam and an outseam are defined at a juncture of said front and rear leg panels.

7. The unitary garment of claim 1, wherein said closing means comprises a zipper.

8. The unitary garment of claim 1, additionally including a pair of kneepad panels being mounted on said front leg panels of each of said leg members for defining a cushioning compartment between said front leg panels and said kneepad panels; and a cushioning member for cushioning a pair of knees of a user kneeling in said pants portion, said cushioning member being mounted in said cushioning compartment.

9. The unitary garment of claim 1, wherein said front leg panels of each of said leg members has an opening extending therein for providing access to a pair of front pockets, an inner pocket panel being coupled to an edge of said front leg panels defining said opening, said inner pocket panel defining said interior of each of said front pockets.

10. The unitary garment of claim 1, additionally including an edge of each of said rear pocket panels defining an access opening for accessing each of said rear pockets, a pair of flap members being mounted on said buttocks area of said pants portion and being positioned adjacent to said edge of said rear pockets for selectively covering said access opening of each of said rear pockets.

11. The unitary garment of claim 1, wherein said jacket portion of said coveralls includes an open collar end, a pair of breast jacket panels being coupled to and extending between said collar end of said jacket portion and a waistband of said pants portion, a back jacket panel being coupled to and extending between said collar end of said jacket portion and said waistband of said pants portion.

12. The unitary garment of claim 11, additionally including a pair of arm members for receiving a pair of arms of a user, each of said arm members being coupled to and extending away from said breast and back jacket panels of said jacket portion, each of said arm members having an open end for selectively receiving a hand of a user.

13. The unitary garment of claim 12, additionally including a pair of elbow pad panels being mounted on said each of said arm members for defining a cushioning compartment between said arm member and said elbow pad panels;

a cushioning member for cushioning a pair of elbows of a user, said cushioning member being mounted in said cushioning compartment between said arm members and said elbow pad panels.

14. The unitary garment of claim 12, additionally including a pair of arm pocket panels being mounted on each of said arm members for defining a pair of arm pockets, an edge of each of said arm pocket panels defining an access opening for accessing each of said arm pockets, each of said arm pocket panels being positioned generally adjacent breast and back jacket panels.

15. The unitary garment of claim 11, wherein each of said breast jacket panels has an opening extending therein for providing access to a pair of front jacket pockets, an inner pocket panel being coupled to an edge of said front breast panels defining said opening, said inner pocket panel defining said interior of each of said front jacket pockets.

16. The unitary garment of claim 11, additionally including a pair of breast pocket panels being mounted on each of said breast jacket panels for defining a pair of breast pockets, an edge of each of said breast pocket panels defining an access opening for accessing each of said breast pockets.

17. The unitary garment of claim 11, wherein said coveralls has a slit extending between said open collar end of said jacket portion and a crotch area of said pants portion for allowing a user to put on said coveralls, an edge of said breast jacket panels and said front leg panels defining said slit in said coveralls; and a closing means for closing said slit in said coveralls, said closing means for closing said slit in said coveralls having a first portion and a second portion, said first and second portions of said closing means for closing said slit in said coveralls being mounted on said edges of said breast jacket panels and said front leg panels, said first and second portions of said closing means for closing said slit in said coveralls being releasably couplable.

18. A unitary garment for covering a head, torso, and legs of a user, said unitary garment comprising:

a pair of coveralls having a pants portion for receiving the legs of the user and a jacket portion for covering the torso of the user;

said pants portion including a waistband and a pair of leg members being coupled to and extending away from said waistband, each of said leg members having an open end for selectively receiving a foot of a user;

said pants portion including a crotch area for receiving a crotch of a user and a buttocks area for receiving a buttocks of a user, said crotch and buttocks area being positioned generally at a juncture of each of said leg members;

each of said leg members including a front leg panel and a rear leg panels being coupled together such that an inseam and an outseam are defined at a juncture of said front and rear leg panels;

said inseam extending between said crotch area and said open end of each of said leg members;

said outseam extending between said waistband and said open end of each of said leg members;

a pair of leg cuffs being mounted on said end of each of said leg members and extending around said open end of each of said leg members;

each of said leg cuffs comprising a substantially flexible material;

said buttocks area of said pants portion including a flap defining an opening for exposing the buttocks of a user, said flap extending from a portion of each of said rear leg panels of said leg members toward said waistband;

a closing means for closing said opening in said buttocks area of said pants portion, said closing means including a first portion and a second portion, said first portion being coupled to an edge of said flap, said second portion being coupled to an edge of said rear leg panels of said pants portion defining said opening, said first portion and said second portion of said closing means being releaseably couplable;

said closing means comprising a zipper;

said outseam of each of said leg members having a slit extending from each of said leg cuffs toward said waistband for selectively widening said open end of each of said leg members;

a closing means for closing said slit in each of said outseams, said closing means for closing said slit in each of said outseams having a first portion and a second portion, said first portion being mounted on an edge of said rear leg panels of said leg members and said second portion being mounted on an edge of said front leg panels of each of said leg members, said first and second portions of said closing means for closing said slit in each of said outseams being releaseably couplable;

said closing means for closing said slit in each of said outseams comprising a zipper;

a pair of kneepad panels being mounted on said front leg panels of each of said leg members for defining a cushioning compartment between said front leg panels and said kneepad panels, each of said kneepad panels being positioned generally between said waistband end and said open end of each of said leg members;

said pair of kneepad panels comprising a generally substantially flexible material;

a cushioning member for cushioning a pair of knees of a user kneeling in said pants, said cushioning member being mounted in said cushioning compartment;

said cushioning member comprising a compressible material;

said front leg panels of each of said leg members having an opening extending therein for providing access to a pair of front pockets, an inner pocket panel being coupled to an edge of said front leg panels defining said opening, said inner pocket panel defining said interior of each of said front pockets, said opening of each of said front pockets being positioned generally adjacent to said waistband;

a pair of rear pocket panels being mounted on said flap of said buttocks area of said pants portion for defining a pair of rear pockets, an edge of each of said rear pocket panels defining an access opening for accessing each of said rear pockets, each of said rear pocket panels being positioned generally adjacent to said waistband of said pants portion;

said pair of rear pocket panels comprising a generally flexible material;

a pair of waistband pocket panels being mounted on said waistband of said pants portion for defining a pair of waistband pockets, an edge of each of said waistband pocket panels defining an access opening for accessing each of said waistband pockets, each of said waistband pocket panels being positioned generally adjacent to said buttocks area of said pants portion;

a heating means for emitting heat and keeping the torso of a user warm, said heating means being removably insertable in said waistband pockets;

said heating means comprising a thermal pack;

said jacket portion of said coveralls including a open collar end, a pair of breast jacket panels being coupled to and extending between said collar end of said jacket portion and said waistband of said pants portion, a back jacket panel being coupled to and extending between said collar end of said jacket portion and said waistband of said pants portion;

a pair of arm members for receiving a pair of arms of a user, each of said arm members being coupled to and extending away from said breast and back jacket panels of said jacket portion, each of said arm members having an open end for selectively receiving a hand of a user;

each of said arm members having an arm cuff mounted on said open end of each of said arm members;

each of said arm cuffs comprising a substantially flexible material;

each of said breast jacket panels having a plurality of pleats formed therein, each of said pleats being positioned generally adjacent to one of said arm members;

each of said breast jacket panels having an opening extending therein for providing access to a pair of front jacket pockets, an inner pocket panel being coupled to an edge of said front breast panels defining said opening, said inner pocket panel defining said interior of each of said front jacket pockets, said opening of each of said front jacket pockets being positioned generally adjacent to said waistband;

a pair of breast pocket panels being mounted on each of said breast jacket panels for defining a pair of breast pockets, an edge of each of said breast pocket panels defining an access opening for accessing each of said breast pockets, each of said breast pocket panels being positioned generally adjacent to said open collar end of said jacket portion;

a pair of elbow pad panels being mounted on said each of said arm members for defining a cushioning compartment between said arm member and said elbow pad panels, each of said elbow pad panels being positioned generally between open end of each of said arm members and said breast and back jacket panels;

said pair of elbow pad panels comprising a generally substantially flexible material;

a cushioning member for cushioning a pair of elbows of a user, said cushioning member being mounted in said cushioning compartment between said arm members and said elbow pad panels;

said cushioning member comprising a compressible material;

a pair of arm pocket panels being mounted on each of said arm members for defining a pair of arm pockets, an edge of each of said breast pocket panels defining an access opening for accessing each of said arm pockets, each of said arm pocket panels being positioned generally adjacent breast and back jacket panels;

each of said pocket panels comprising a substantially waterproof material;

a hood member being mounted on said back jacket panel of said jacket portion for selectively covering a users head, said hood member being positioned generally adjacent to said open collar end of said jacket portion;

said coveralls having a slit extending between said open collar end of said jacket portion and said crotch area of said pants portion for allowing a user to put on said coveralls, an edge of said breast jacket panels and said front leg panels defining said slit in said coveralls; and a closing means for closing said slit in said coveralls, said closing means for closing said slit in said coveralls having a first portion and a second portion, said first and second portions of said closing means for closing said slit in said coveralls being mounted on said edges of said breast jacket panels and said front leg panels;

said closing means for closing said slit in said coveralls comprising a zipper.

* * * * *